US008342237B1

(12) United States Patent
Brewer et al.

(10) Patent No.: US 8,342,237 B1
(45) Date of Patent: Jan. 1, 2013

(54) STUFFING BOX LEAK CONTAINMENT APPARATUS

(75) Inventors: Jack G. Brewer, Chickasha, OK (US); Steven L. Shroyer, Redondo Beach, CA (US); Darrel B. Fruit, Oklahoma City, OK (US); Darrel G. Fruit, Chickasha, OK (US)

(73) Assignee: Anti-Pollution Technology, L.P., Frisco, TX (US)

( * ) Notice: Subject to any disclaimer, the term of this patent is extended or adjusted under 35 U.S.C. 154(b) by 0 days.

(21) Appl. No.: 13/407,214

(22) Filed: Feb. 28, 2012

Related U.S. Application Data

(63) Continuation of application No. 13/155,999, filed on Jun. 8, 2011, now Pat. No. 8,127,838.

(51) Int. Cl.
*E21B 33/08* (2006.01)

(52) U.S. Cl. ..... 166/81.1; 166/93.1

(58) Field of Classification Search ..... 166/81.1, 166/79.1, 84.1, 93.1, 75.13, 379, 364, 365, 166/363, 360
See application file for complete search history.

(56) References Cited

U.S. PATENT DOCUMENTS

| | | | | | |
|---|---|---|---|---|---|
| 2,096,882 | A | * | 10/1937 | Chernosky | 166/81.1 |
| 3,270,810 | A | * | 9/1966 | Johnston | 166/84.1 |
| 4,321,975 | A | * | 3/1982 | Dyer | 175/206 |
| 4,665,976 | A | * | 5/1987 | Retherford | 166/81.1 |
| 4,872,508 | A | * | 10/1989 | Gordon | 166/84.2 |
| 5,150,751 | A | | 9/1992 | Burton et al. | |
| 5,351,753 | A | * | 10/1994 | Golson | 166/81.1 |
| D365,353 | S | | 12/1995 | Brewer | |
| 5,484,024 | A | | 1/1996 | Ladd et al. | |
| 5,775,419 | A | | 7/1998 | Gramlich | |
| 5,937,947 | A | | 8/1999 | Holtby | |
| 6,286,593 | B1 | | 9/2001 | Holtby | |
| 6,386,225 | B1 | | 5/2002 | Holtby | |
| 2002/0179300 | A1 | * | 12/2002 | Gay et al. | 166/81.1 |
| 2004/0182567 | A1 | * | 9/2004 | Matthews | 166/81.1 |

OTHER PUBLICATIONS

Stabilizer Bar for Use with a Leak Container for an Oil Well Stuffing Box; Jack Brewer; 1994; United States.
Sales Brochure; Pollution Control Corporation, 2000; United States.
The Trapper™ Installation Information; Pollution Control Corporation, 1997; United States.

* cited by examiner

*Primary Examiner* — Kenneth L Thompson
(74) *Attorney, Agent, or Firm* — McAfee & Taft

(57) ABSTRACT

An apparatus for containing leaks from a stuffing box on a wellhead production assembly is provided. The apparatus comprises a containment vessel consisting of two half shells that are joined below the stuffing box. The apparatus further comprises a seal subassembly. The components of the seal subassembly are positioned one the nipple and pumping tee below the stuffing box. The half shells are positioned about and joined to the seal subassembly in a manner that provides a liquid tight seal. Additionally, the apparatus comprises a transparent topper having an upper opening to receive a polished rod extending from the stuffing box. The topper is secured to the containment vessel in a liquid tight manner such that the stuffing box is substantially isolated from the environment. As such, any leaks originating from the stuffing box will be contained in the apparatus.

20 Claims, 16 Drawing Sheets

STUFFING BOX LEAK CONTAINMENT APPARATUS

CROSS-REFERENCE TO RELATED APPLICATIONS

The present application is a continuation of U.S. patent application Ser. No. 13/155,999, filed Jun. 8, 2011 now U.S. Pat. No. 8,127,838.

FIELD OF INVENTION

The present invention relates to an apparatus for containing leaks from a stuffing box at a wellhead as well as methods for using the same.

BACKGROUND

A common problem with wellhead production equipment is that many of the structures associated with a wellhead, such as a stuffing box and polished rod, are susceptible to leaking. As a result, the surrounding environment can be exposed to oil or other fluids which can have deleterious effects on local plants and wildlife. To solve this problem, devices are positioned around portions of the stuffing box and well head to contain the leaking material. However, prior containment devices suffer from one or more of the following problems: (1) tedious assembly of the device on the wellhead and tedious removal; (2) disassembly of the device to access stuffing box; (3) disassembly of the device to visually inspect the stuffing box; (4) lack of a proper liquid seal; and (5) difficulty maintaining the device in a fixed position on the well head. As a result of these problems, wellhead operators are more reluctant to utilize containment devices ultimately leading to an increase in pollution.

The present invention seeks to alleviate these problems by providing a containment apparatus that (1) is easily assembled on the wellhead, (2) provides a liquid tight seal around the stuffing box (3) provides easy access to the stuffing box, and (4) allows for visual inspection of the stuffing box while the apparatus is in place. Such an invention promotes environmentally conscious behavior without the detriment of significant increases in cost and time.

SUMMARY

As known to those skilled in the art, wellhead production equipment typically includes a stuffing box carried on the nipple of a pumping tee. The present invention provides a leak prevention apparatus suitable capturing leaks originating at the stuffing box. The apparatus includes a first gasket positioned on the nipple and a seal ring positioned over the first gasket. The seal ring has an upper end carrying an external circumferential groove and a lower end with an outwardly projecting flange. The flange interrupted by at least two slots. The apparatus also includes a stabilizer bar having at least two upwardly extending flanges. When positioned on the pumping tee, the stabilizer bar's upwardly extending flanges extend through the slots of the seal ring. Positioned within the circumferential groove of the seal ring is a second gasket. To capture any leaks, the apparatus includes a liquid tight containment vessel comprising a first half shell and a second half shell. Alignment of the first half shell with the second half shell defines the liquid tight containment vessel. The containment vessel has a lower opening. The lower opening cooperates with the second gasket to provide a liquid tight seal when the containment vessel is positioned on the seal ring. Additionally, the lower opening carries two tabs. When the liquid tight containment vessel is positioned on the seal ring, the tabs are adjacent to the upwardly extending flanges of the stabilizer bar. In a preferred embodiment, a top is placed on the vessel to completely enclose the stuffing box. The top has an upper opening to receiving a polished rod extending from the stuffing box.

In another embodiment, the present invention provides a leak prevention apparatus suitable for mounting on the top of a stuffing box. The stuffing box has an upper lube cap with at least one threaded hole and a polished rod passing through the upper lube cap. The leak prevention apparatus includes a first gasket positioned on the upper lube cap. The first gasket substantially conforms to the geometry of the surface of the upper lube cap and has at least a first hole corresponding to the threaded hole in the upper lube cap and a second hole that permits passage of the polished rod. The leak prevention apparatus further includes a liquid tight containment vessel wherein alignment of a first half shell with a second half shell defines the liquid tight containment vessel. The containment vessel has at least a first lower opening and a second lower opening corresponding and aligning with the threaded hole in the upper lube cap such that passage of a thread bolt through the first lower opening secures the liquid tight containment vessel to the upper lube cap. Cooperation of the first gasket and the first lower opening provides a liquid tight seal.

BRIEF DESCRIPTION OF THE DRAWINGS

FIG. 6 is a front view of a preferred embodiment of the containment vessel in the open position depicting the orientation of the containment vessel 30 with respect to the components of the seal subassembly.

FIG. 8 is an exploded view of a gasket being positioned on the lube cap of a stuffing box for the top-mounting embodiment.

FIG. 13 represents an exploded, perspective view of the gasket and containment vessel mounted on the lube cap of a stuffing box.

DETAILED DESCRIPTION

The present invention relates to a containment apparatus for containing leaks from a stuffing box at a wellhead. Depending on the configuration of the wellhead and the type of stuffing box utilized, the containment apparatus may be secured at a location below or above the stuffing box. The present invention strategically positions gasket material to provide a liquid-tight seal between the containment apparatus and the stuffing box thereby maximizing fluid retention in the containment vessel. The present invention provides the ability to stabilize and maintain the containment vessel in a vertical configuration on the wellhead. This configuration overcomes the tendency of prior art devices to become loose leading to a loss of seal and undesirable apparatus contact with the polished rod or other components of the stuffing box.

The present invention also provides the ability to access the stuffing box and polish rod without completely removing the containment apparatus from the wellhead. Similarly, the present invention permits visual inspection of the stuffing box and polished rod without removing any portion of the apparatus. These advantages and others will become apparent upon examination of the proceeding written description and drawings.

Figure 2A:
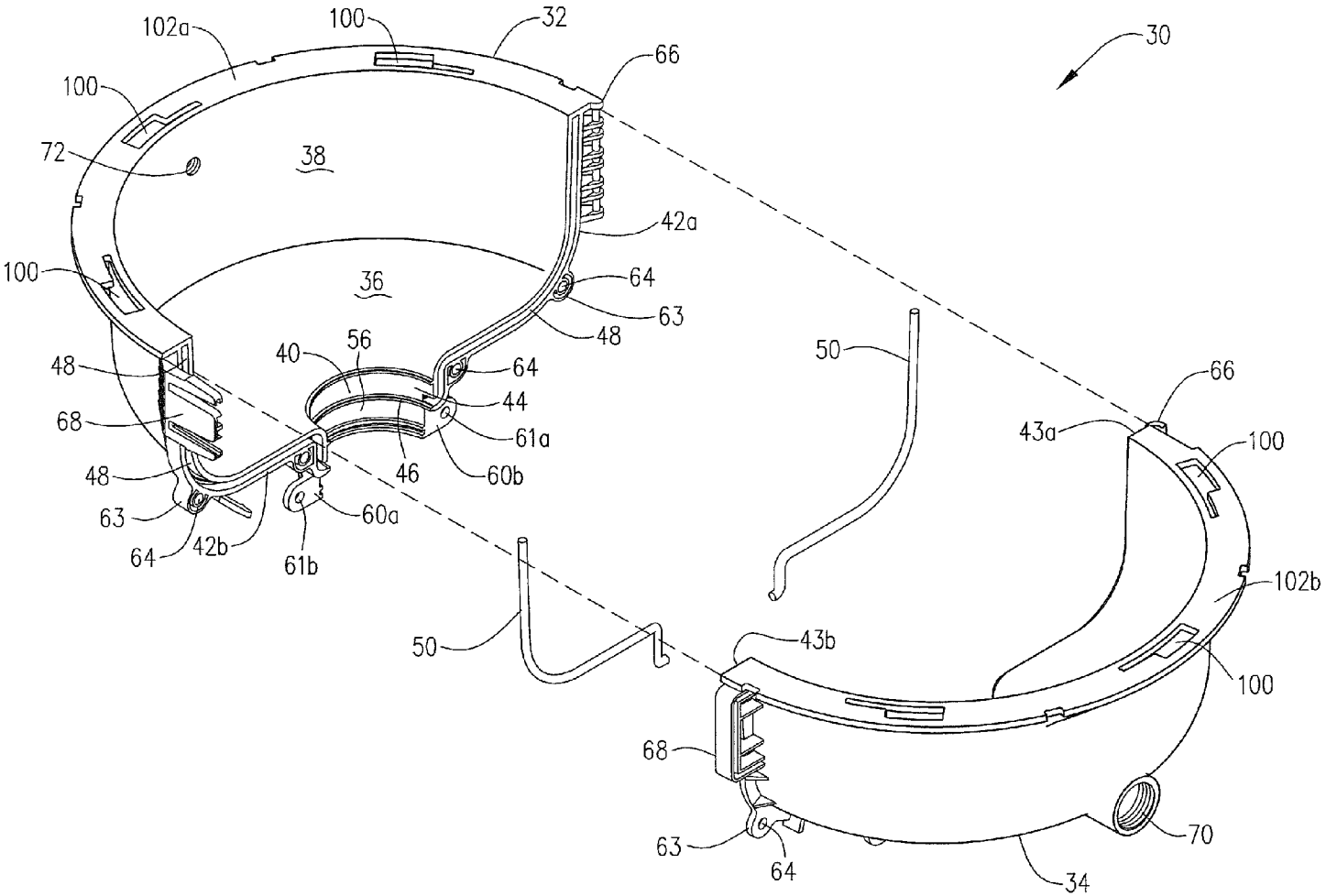
FIG. 2A is an exploded perspective view of a preferred embodiment of a containment vessel.
Figure 2:
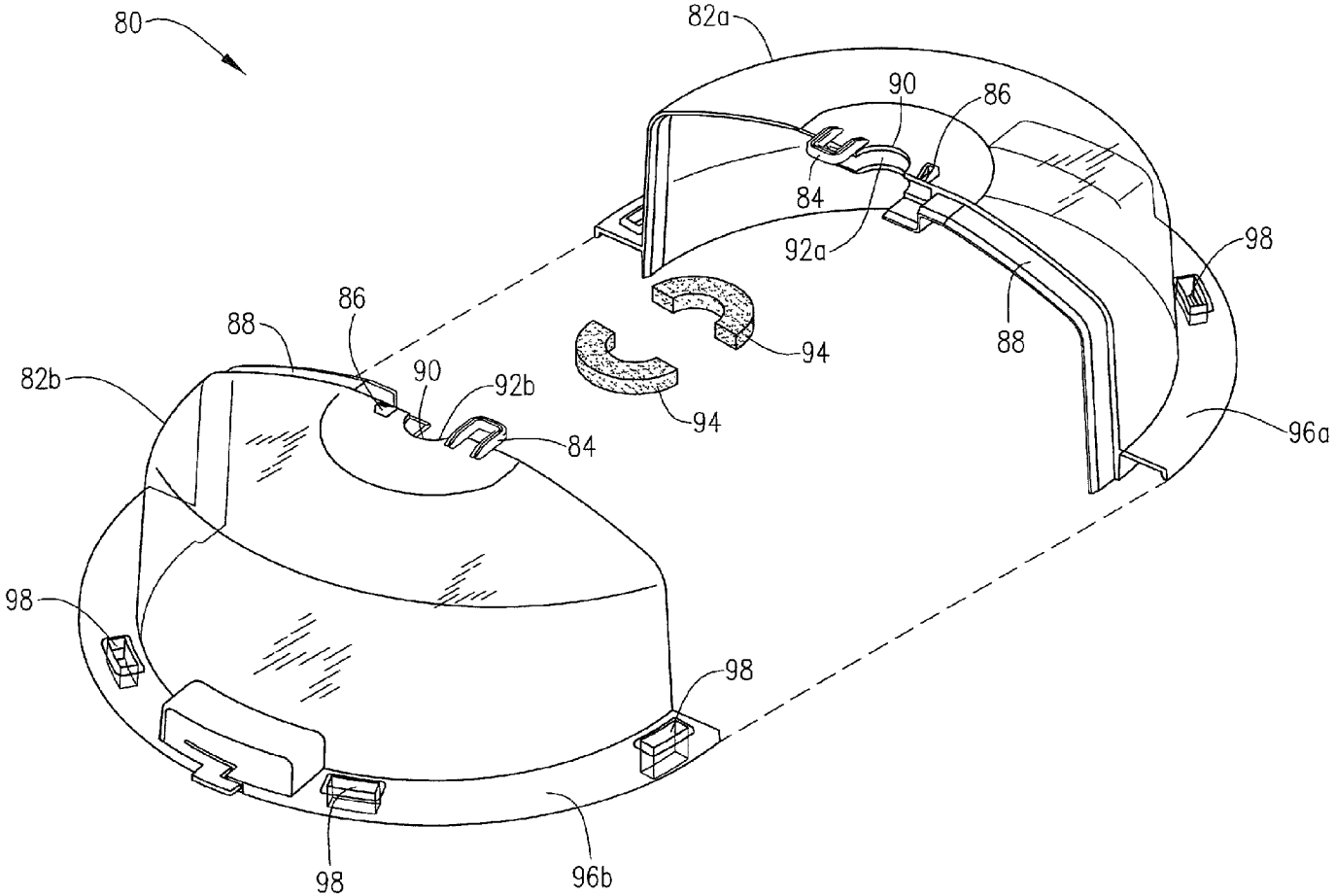
FIG. 2B is an exploded perspective view of a preferred embodiment of a topper for the containment vessel.
FIG. 2C is a perspective view of a preferred embodiment of the containment vessel with the topper.
Figure 2C:
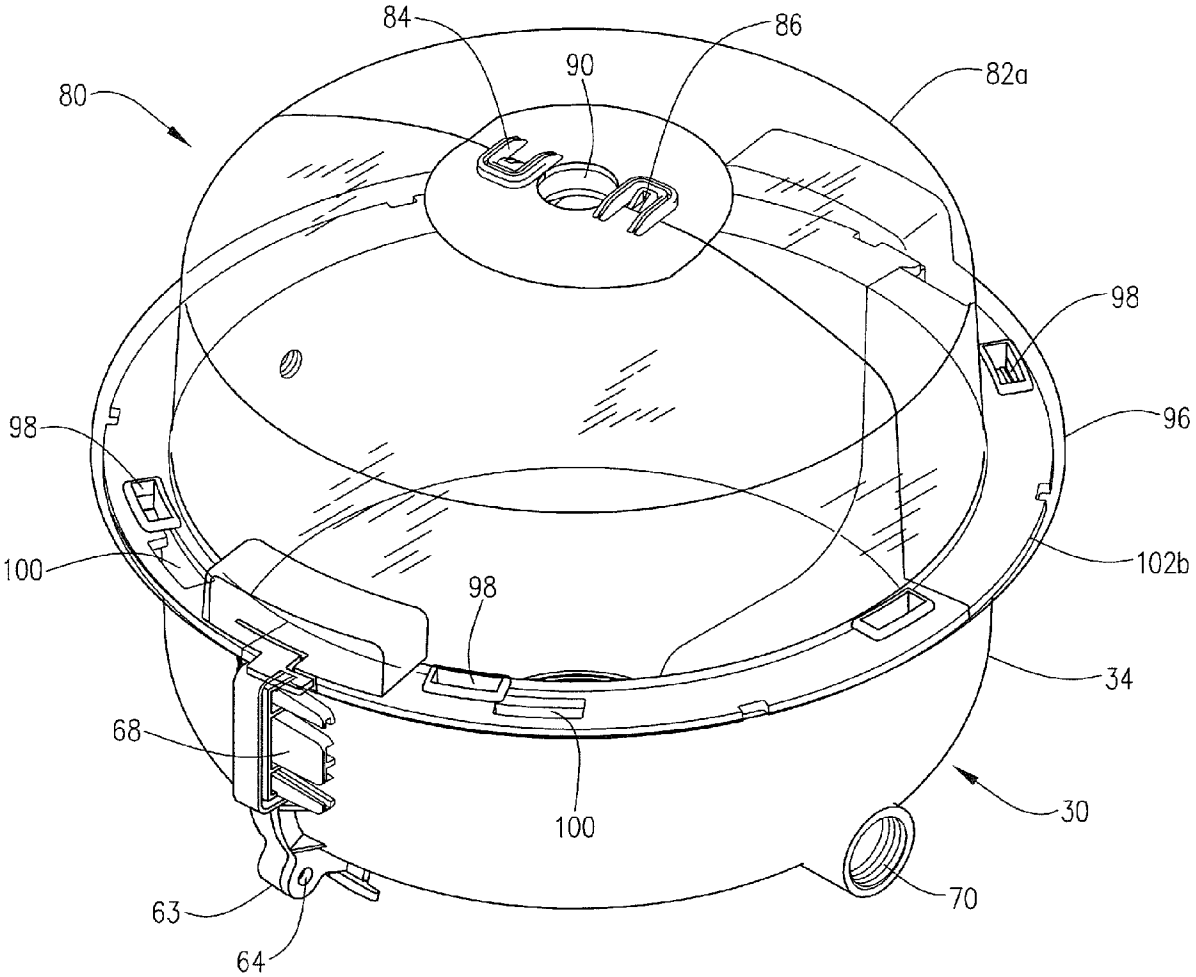
Figure 3:
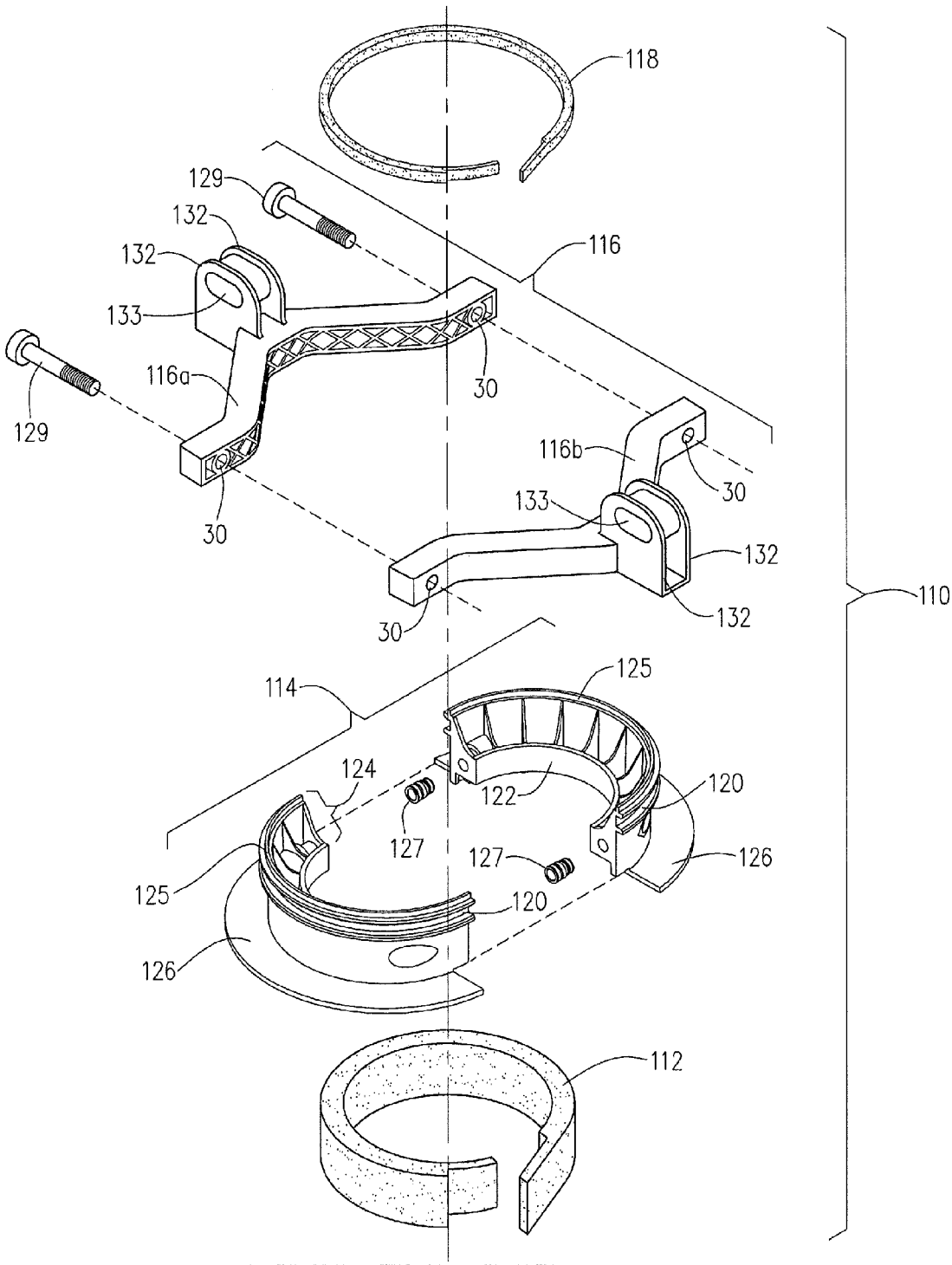
FIG. 3 is an exploded, perspective view of the components of a preferred embodiment of a seal subassembly.

The stuffing box containment apparatus 10 of the present invention can be divided into essentially three primary components: (1) a containment vessel 30, the individual parts of which are depicted in FIGS. 2A and 2C; (2) a topper 80 or lid, the individual parts of which are depicted in FIGS. 2B and 2C; and (3) a seal subassembly 110, the individual parts of which are depicted in FIG. 3.

Figure 1B:
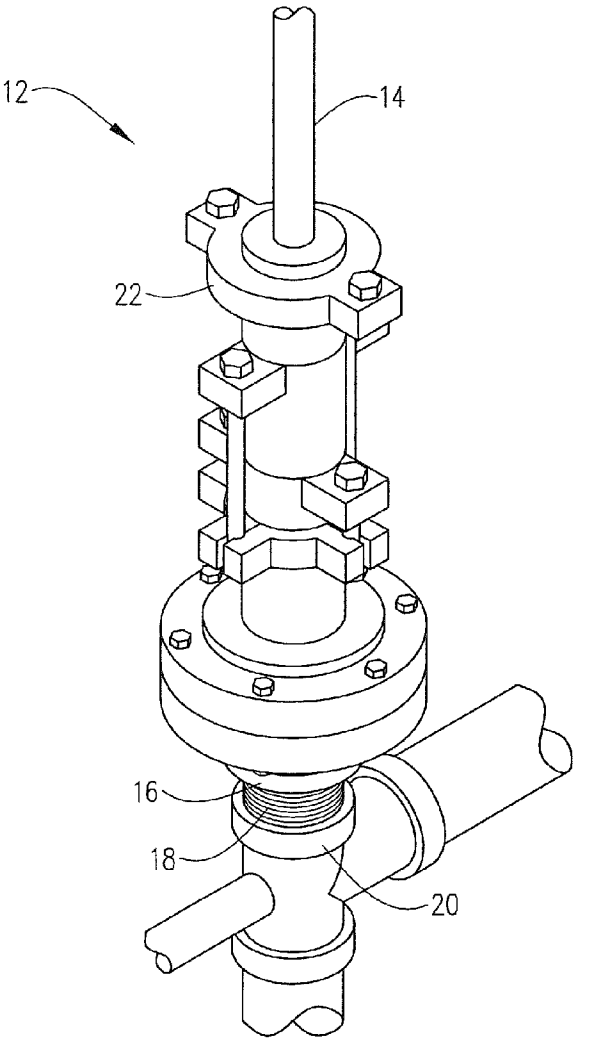
FIG. 1B is a perspective view of a stuffing box assembly on a wellhead.
Figure 1A:
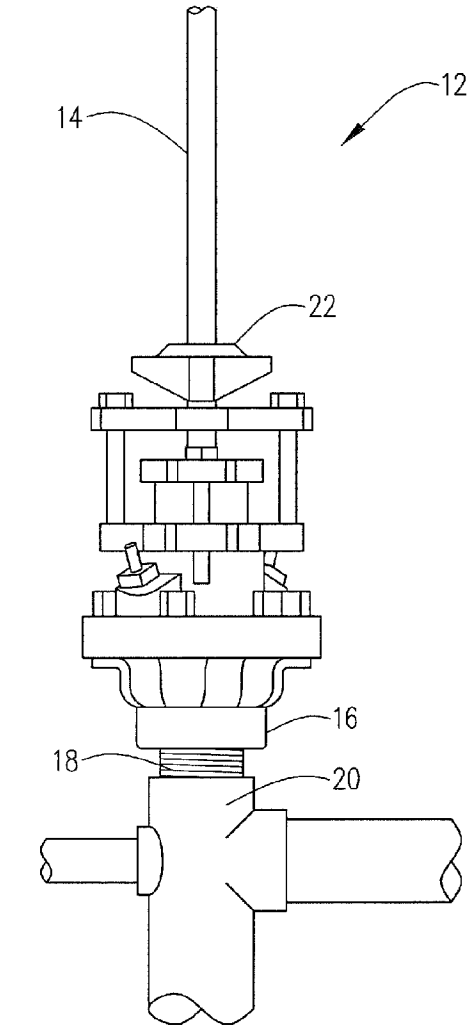
FIG. 1A is a front view of a stuffing box assembly on a wellhead.

To provide a frame of reference for the present invention, FIGS. 1A and 1B depict a typical stuffing box 12 on a wellhead. In relevant part, the stuffing box comprises a polished rod 14, a stuffing box base 16, a nipple 18, a pumping tee 20 and a lube cap 22.

Referring now to FIG. 2A, a preferred embodiment of a containment vessel 30 is illustrated. When assembled on stuffing box 12, a first half shell 32 and a second half shell 34 form containment vessel 30. As first and second half shells 32, 34 are essentially mirror images, the common features will be discussed with respect to first half shell 32 noting any differences between half shells 32, 34. First half shell 32 contains a floor portion 36, an upstanding wall portion 38, a collar portion 40 and a pair of mating surfaces 42*a*, 42*b*. Mating surfaces 42*a*, 42*b* define the transition from floor portion 36 and upstanding wall portion 38 and further provide the contact surfaces between first half shell 32 and second half shell 34. Mating surfaces 42*a*, 42*b* extend down to collar portion 40 terminating adjacent to a circumferential groove 46 in collar portion 40. Additionally, a recessed channel 48 is defined in each mating surface 42*a*, 42*b* of the first half shell 32 and extends the length of mating surfaces 42*a*, 42*b* terminating in alignment with the circumferential groove 46 of the collar portion 40. Positioned within channel 48 is a first sealing material 50. Second half shell 34 contains a ridge 52 on its mating surfaces 43*a*, 43*b* (see FIG. 5) that corresponds in position to channel 48 of the first half shell 32. Thus, when first and second half shells 32, 34 are combined to form containment vessel 30, channel 48 receives ridge 52 compressing sealing material 50 therein to provide a liquid tight seal.

Collar portion 40 comprises an upper collar portion 44 and a lower collar portion 56. The upper collar portion 44 is separated from the lower collar portion 56 by circumferential groove 46. The lower collar portion 56 terminates on either end with two tabs 60*a*, 60*b* (first half shell) or 60*c*, 60*d* (second half shell) extending laterally in opposite directions therefrom. As can be seen in FIG. 2A, tabs 60*a*, 60*b* are set back from mating surfaces 42*a*, 42*b* such that when half shells 32, 34 are joined, a space exists between tabs 60*a*, 60*b* of first half shell and opposing tabs 60*c*, 60*d* of second half shell providing for engagement with seal subassembly 110 (discussed further herein below with respect to FIGS. 5 and 6). Each tab 60*a*, 60*b* (of first half shell) and 60*c*, 60*d* (of second half shell) has an opening 61*a*, 61*b* and 61*c*, 61*d*, respectively, suitable for receiving a bolt or pin. Additional attachment points are provided along the length of each mating surface 42*a*, 42*b*, 43*a*, 43*b*. Preferred attachment points are outwardly projecting lobes or ears 63 each having at least one opening 64 capable of receiving a bolt or pin to tightly secure the first half shell 32 to the second half shell 34. As depicted, lobes 63 on one half shell 32, 34 correspond to the lobes 63 on the other half shell.

Continuing with FIG. 2A, first half shell 32 and second half shell 34 each preferably provide latching components such as, but not limited to, a hinge 66 and buckle 68 to permit separation of the half shells 32, 34 without removal from the wellhead. In this aspect, hinge connection 66 allows the containment vessel 30 to be opened by releasing the buckle 68 thereby permitting access to the stuffing box 12 without requiring the vessel 30 to be removed from the wellhead. Those skilled in the art will recognize that shells 32, 34 could be coupled in a number of different manners while retaining the advantage of access to stuffing box 12 without removal of vessel 30. For example, two buckles could be utilized that permit one of the half shells to be selectively removed for access to stuffing box 12 or replacement upon damage. Furthermore, mating surfaces 42*a*, 42*b* could be adapted to provide additional lobes 63 with openings 64 in place of the buckle 68. Containment vessel 30 can additionally contain a number of other features such as a drain port 70 and a plug 72 adapted to receive an optional float or kill switch.

Referring now to FIG. 2B, containment apparatus 10 preferably includes a transparent lid or topper 80 for containment vessel 30. Although preferred, transparency is merely optional. Transparency of topper 80 permits the visual inspection of stuffing box 12 without removing any portion of the apparatus 10. In a preferred embodiment, the topper 80 is divided into half portions 82*a*, 82*b* which can be secured together by a variety of mechanisms. In a preferred embodiment, half portions 82*a*, 82*b* are secured by joining a hook 84 on one half portion to a tab 86 on the opposite half portion. In order to provide a liquid seal, each half portion 82*a*, 82*b* provides a flange 88 extending from opposite edges of each half portion. Upon attachment of the half portions 82*a*, 82*b*, each flange 88 extends under the opposing half portion thereby providing a barrier at the joined edges of the half portions. Alternatively, one half portion may carry both flanges 88 which slide under the other half portion to provide the desired barrier. When assembled, topper 80 provides an upper opening 90 sufficient to permit passage of polished rod 14. Upper opening 90 carries recessed grooves or channels 92*a*, 92*b* on each half portion 82*a*, 82*b* suitable for receiving protective material 94, such as felt. Protective material 94 should extend past the edges of the channels 92*a*, 92*b* in order to prevent polished rod 14 from contacting the edges of upper opening 90. Topper 80 preferably has a height sufficient to clear the top of stuffing box 12. More preferably, topper 80 has a height between 10" and 20".

Topper 80 can be attached to containment vessel 30 in a number of different manners which will be apparent to those skilled in the art. Preferably, topper half portions 82*a*, 82*b* carry a lower rim 96*a*, 96*b* extending horizontally from the bottom edge of the topper half portions 82*a*, 82*b*. Each lower rim 96*a*, 96*b* carries one or more downwardly projecting tabs 98. (Only the upper surface of tabs 98 is visible in FIG. 2A and FIG. 2C.) Downwardly projecting tabs 98 are configured to be received by one or more bayonet mount receiving slots 100 spaced accordingly on an upper rim 102*a*, 102*b* of the containment vessel 30 (see FIG. 2A). Lower rim 96*a*, 96*b* of the topper 80 is placed on upper rim 102*a*, 102*b* such that downwardly projecting tabs 98 are aligned with the bayonet mount receiving slots 100. The topper 80 is locked in place by turning it clockwise to move tabs 98 into the proper position with the bayonet mount receiving slots 100. FIG. 2C depicts the containment vessel 30 and topper 80 as properly joined for use on a wellhead.

Referring now to FIG. 3, the components of a preferred embodiment of the seal subassembly 110 will be described. In this embodiment, seal subassembly 110 comprises a first gasket 112, a seal ring 114 having inner and outer walls 122 and 125, a stabilizer bar 116 and a second gasket 118. First gasket 112 is preferably a foam gasket of a size sufficient to cover nipple 18 between pumping tee 20 and stuffing box base 16 as demonstrated in FIG. 4A. More preferably, first gasket 112 is approximately ⅞"×9.35" or 10.92" (depending on the circumference of the stuffing box nipple)×⅜". As depicted inner wall 122 is offset from outer wall 125. In the preferred embodiment, downwardly sloping ribs 123 connect inner wall 122 to outer wall 125. This configuration provides strength while reducing weight; however, other configurations for joining inner and outer walls will also perform satisfactorily.

Figure 4A:
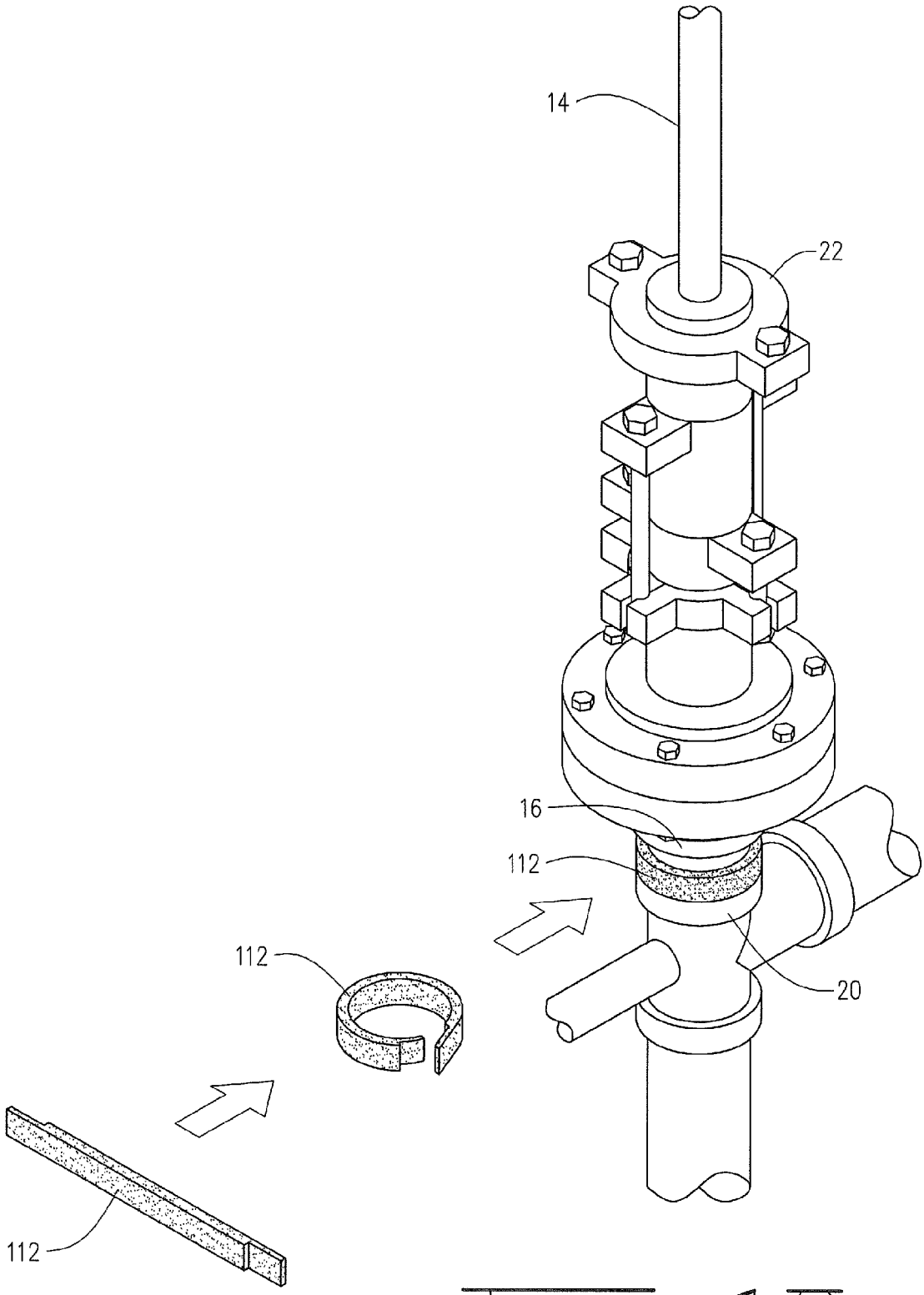
FIG. 4A is an exploded, perspective view depicting the positioning of the first gasket 112 on the nipple of the pumping tee below the stuffing box.
Figure 4B:
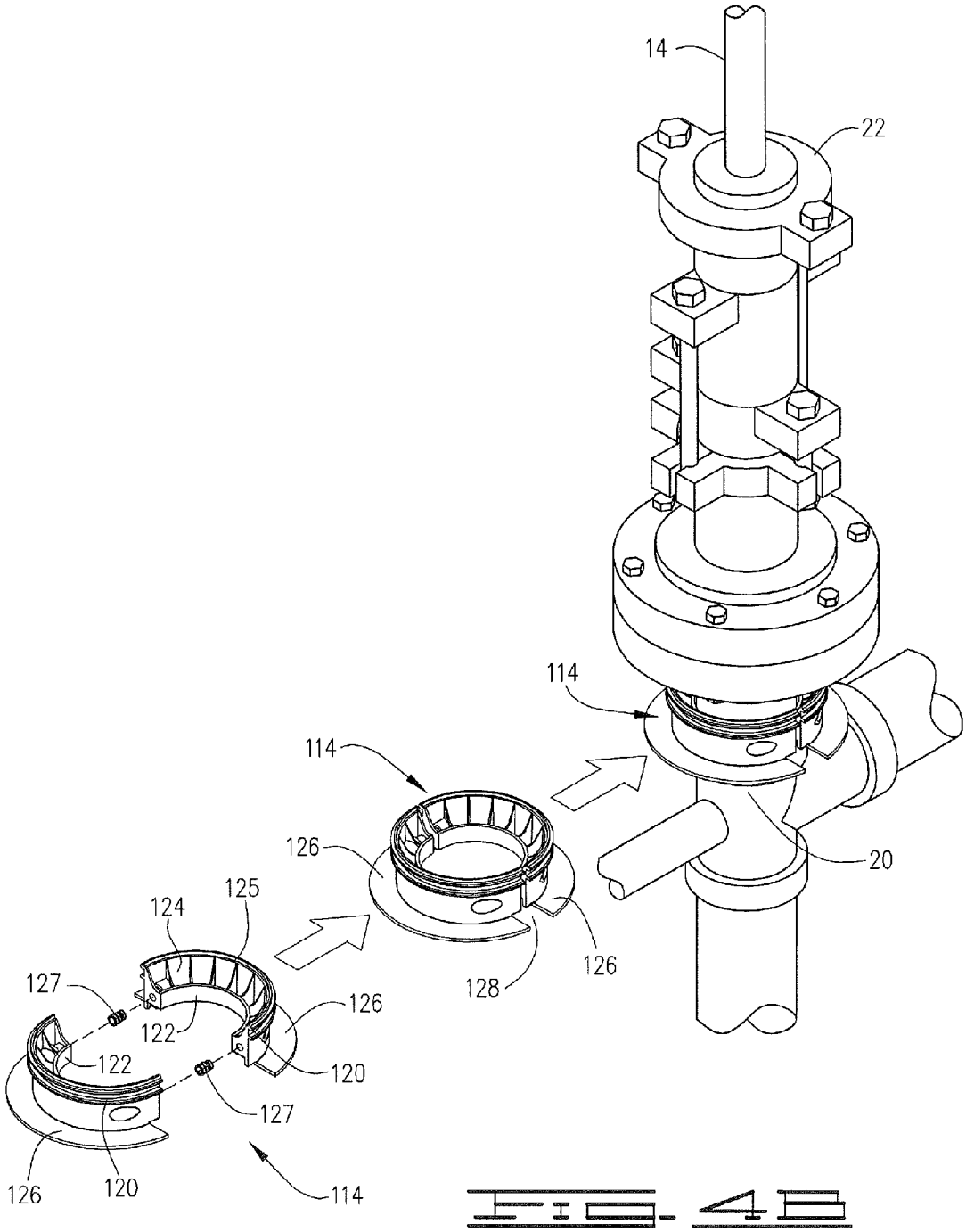
FIG. 4B is an exploded, perspective view depicting the positioning of the seal ring 114 on the nipple of the pumping tee below the stuffing box.

Continuing with seal subassembly 110, seal ring 114 is positioned around nipple 18 overlying first gasket 112 as depicted in FIG. 4B. Seal ring 114 has an external circumferential groove 120 carried by outer wall 125 and extending around the upper end of seal ring 114. Seal ring 114 inner wall 122 provides the portion of the seal ring 114 that will contact first gasket 112 on nipple 18. To permit positioning of seal subassembly 110 as close as possible to the lower portion of stuffing box 16, the overall height of wall 122 is less than the height of outer wall 125. The difference in height provides a void space 124 in assembled seal ring 114 suitable for receiving the lower portion of stuffing box 16.

Seal ring 114 also has an outwardly projecting flange 126 that extends around the lower end of seal ring 114. Flange 126 is interrupted by at least one slot 128. Preferably, flange 126 is interrupted on opposite sides to provide a pair of slots 128. As depicted in FIGS. 3 and 4B, seal ring 114 comprises two half portions 114*a*, 114*b* that are joined around nipple 18. Seal ring halves 114*a*, 114*b* can be joined through a variety of different mechanisms, but preferably bolts 127 are used to join seal ring 114 around nipple 18 of the wellhead.

In an alternative embodiment (not depicted), a belt gasket can be used in lieu of the seal ring 114. The belt gasket is preferably a 3.5" gasket that extends from the top portion of the pumping tee 20 to the bottom portion of the stuffing box base 16. Thus, this embodiment can be used in wellheads where the nipple 18 is not large enough to permit attachment of the seal ring 114. Alternatively, this embodiment can be used where the stuffing box base 16 is too large to be received by void 124. In this embodiment, parting line gaskets (not shown) are placed over the portion of mating surfaces 42*a* and 42*b* such that a portion, preferably ⅛", of the gasket material protrudes into the cylindrical passage defined by collar 40.

Figure 4C:
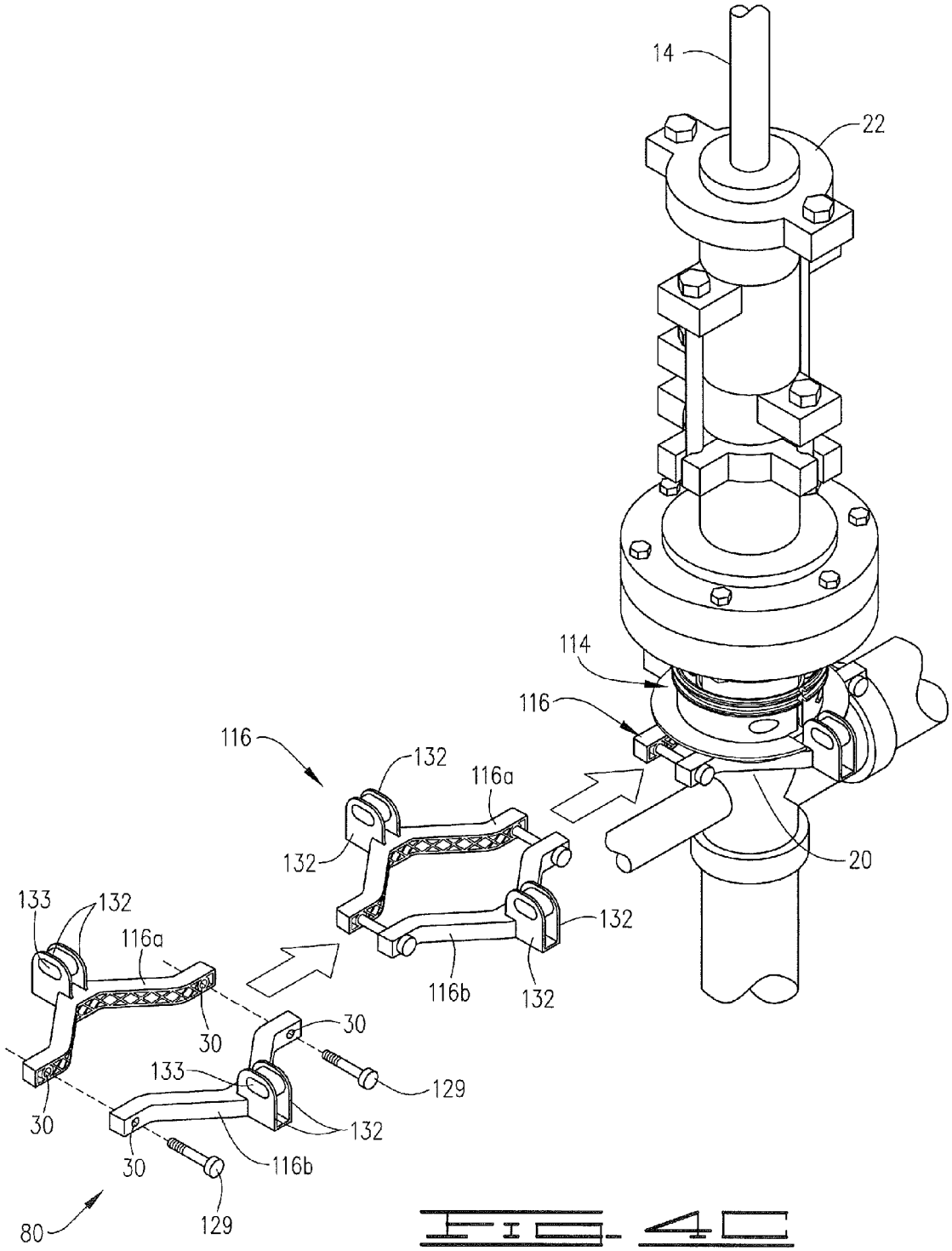
FIG. 4C is an exploded, perspective view depicting the positioning of the stabilizer bar 116 on the nipple below the seal ring 114.

Turning now to FIG. 4C, a stabilizer bar 116 is provided. Stabilizer bar 116 provides a stable, secure base for positioning containment vessel 30 on the wellhead. Thus, stabilizer bar 116 prevents containment vessel 30 from slipping downward or changing position. To this end, stabilizer bar 116 is positioned on pumping tee 20 just below nipple 18 such that laterally projecting flange 126 of seal ring 114 rests on the top surface of stabilizer bar 116. Stabilizer bar 116 is secured to the pumping tee by two bolts 129 extending through openings 130 at the ends of each half 116*a*, 116*b* of stabilizer bar 116. Stabilizer bar 116 further provides at least two sets of upwardly extending flanges 132 with each flange 132 having an opening 133 defined therein. In the preferred embodiment, each half 116*a*, 116*b* carries a pair of flanges 132. Stabilizer bar 116 is oriented on the pumping tee such that upwardly extending flanges 132 are received within slots 128 of seal ring 114.

Figure 4D:
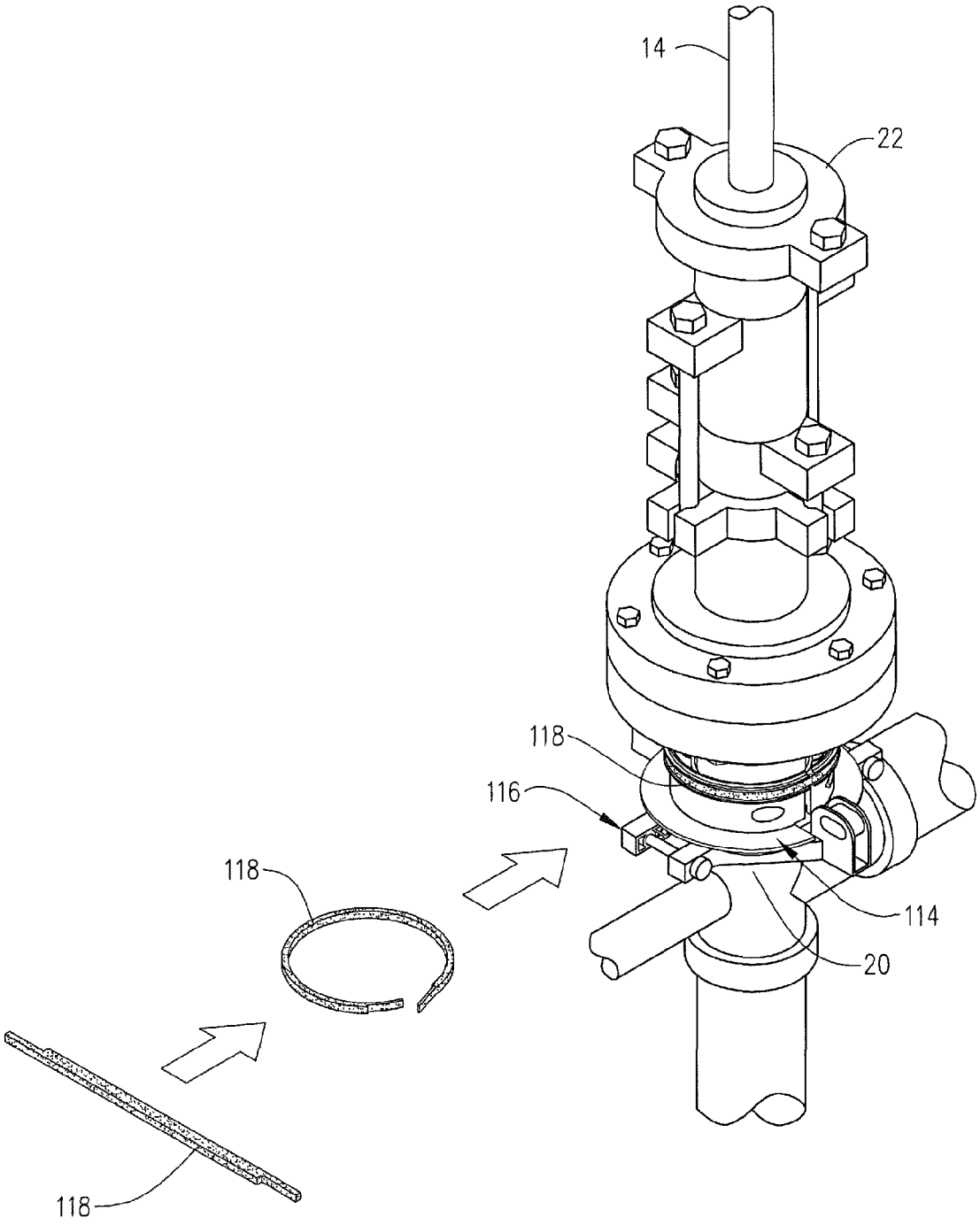
FIG. 4D is an exploded, perspective view depicting the positioning of the second gasket 118 in the circumferential groove of the seal ring 114.

As depicted in FIG. 4D, a second gasket 118 is placed in the circumferential groove 120 of the seal ring 114. The second gasket 118 is preferably ¼"×15.74"×⅛". Second gasket 118 will ultimately mate with sealing material 50 present in channel 48 of first half shell 32 and will further align with circumferential groove 46 on collar portion 40 of containment vessel 30.

Figure 5:
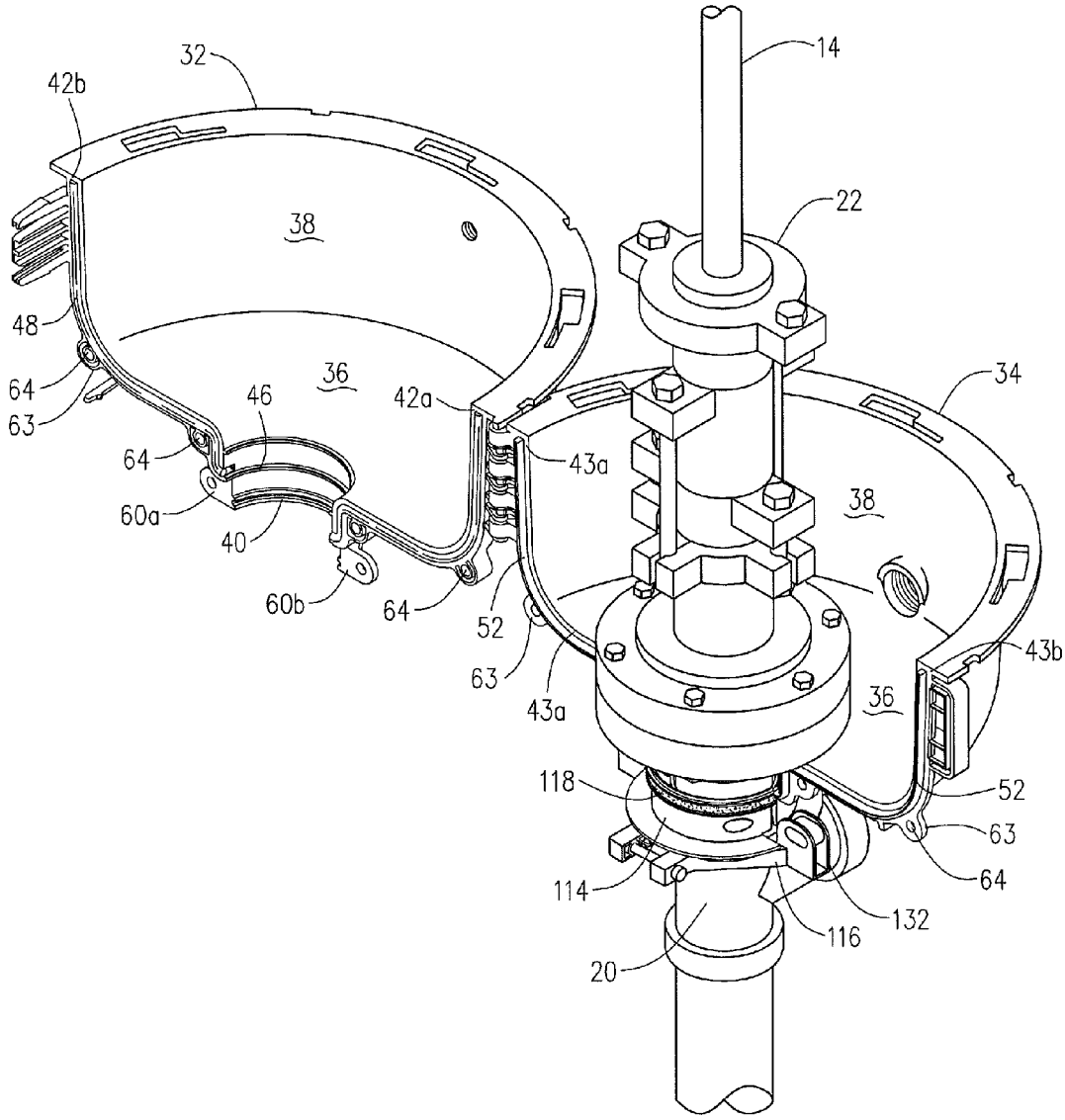
FIG. 5 is a perspective view of a preferred embodiment of the containment vessel in an open configuration with the seal subassembly positioned on the wellhead.
Figure 5:
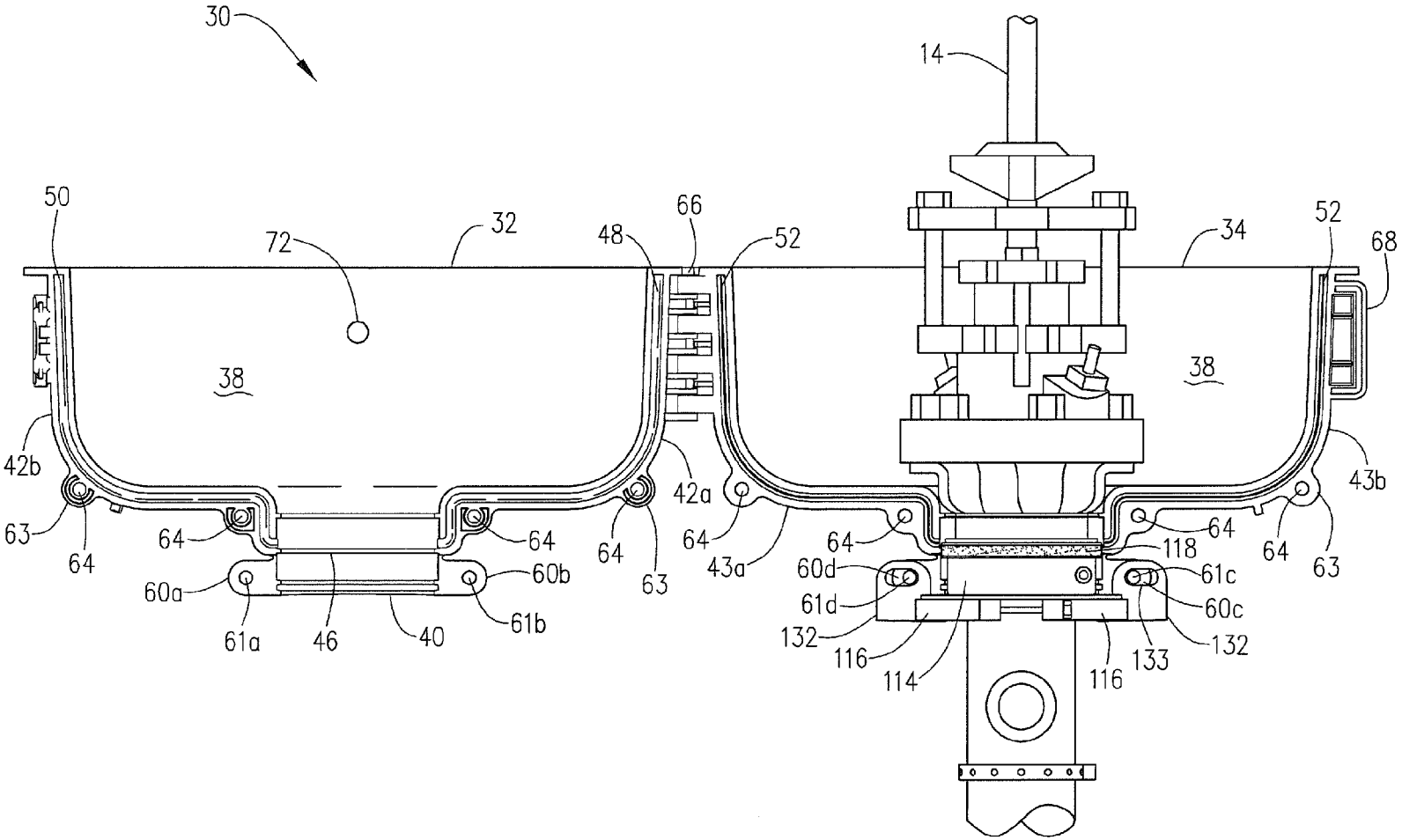

FIGS. 5 and 6 depict containment vessel 30 positioned on seal subassembly 110 with stabilizer bar 116 positioned beneath seal subassembly 110. When properly positioned, tabs 60*c*, 60*d* of second half shell 34 are aligned with upwardly extending flanges 132 of stabilizer bar 116. Upon alignment of second half shell 34 with the components of the seal subassembly 110, first half shell 32 can be joined to form containment vessel 30. Thus, tabs 60*a*, 60*b* of first half shell 32 are aligned with upwardly extending flanges 132 of stabilizer bar 116. As such, each set of flanges 132 are flanked by opposing tabs 60*a*, 60*c* and 60*b*, 60*d* thereby aligning tab openings 61*a-d* with flange openings 133. A bolt or pin 134 can then be placed through the aligned openings to secure first half shell 32 and second half shell 34 to stabilizer bar 116. Accordingly, stabilizer bar 116 supports containment vessel 30 with or without use of seal ring 114.

Additionally, ridges 52 on mating surfaces 43*a*, 43*b* of second half shell 34 are aligned with and compress sealing material 50 contained in channels 48 on mating surfaces 42*a*, 42*b* of first half shell 32 creating a liquid tight seal at the junction seam of the two halves of the containment vessel 30. Moreover, channel 48 of first half shell 32 terminates at circumferential groove 120 of seal ring 114 such that sealing material 50 disposed in channel 48 will contact second gasket 118 in circumferential groove 120. External circumferential groove 120 of seal ring 114 also aligns with circumferential groove 46 of collar portions 40 on first half shell 32 and second half shell 34. Finally, buckle components 68 are secured and bolts or pins are positioned through the now aligned openings 64 to further secure the half shells together.

Figure 7:
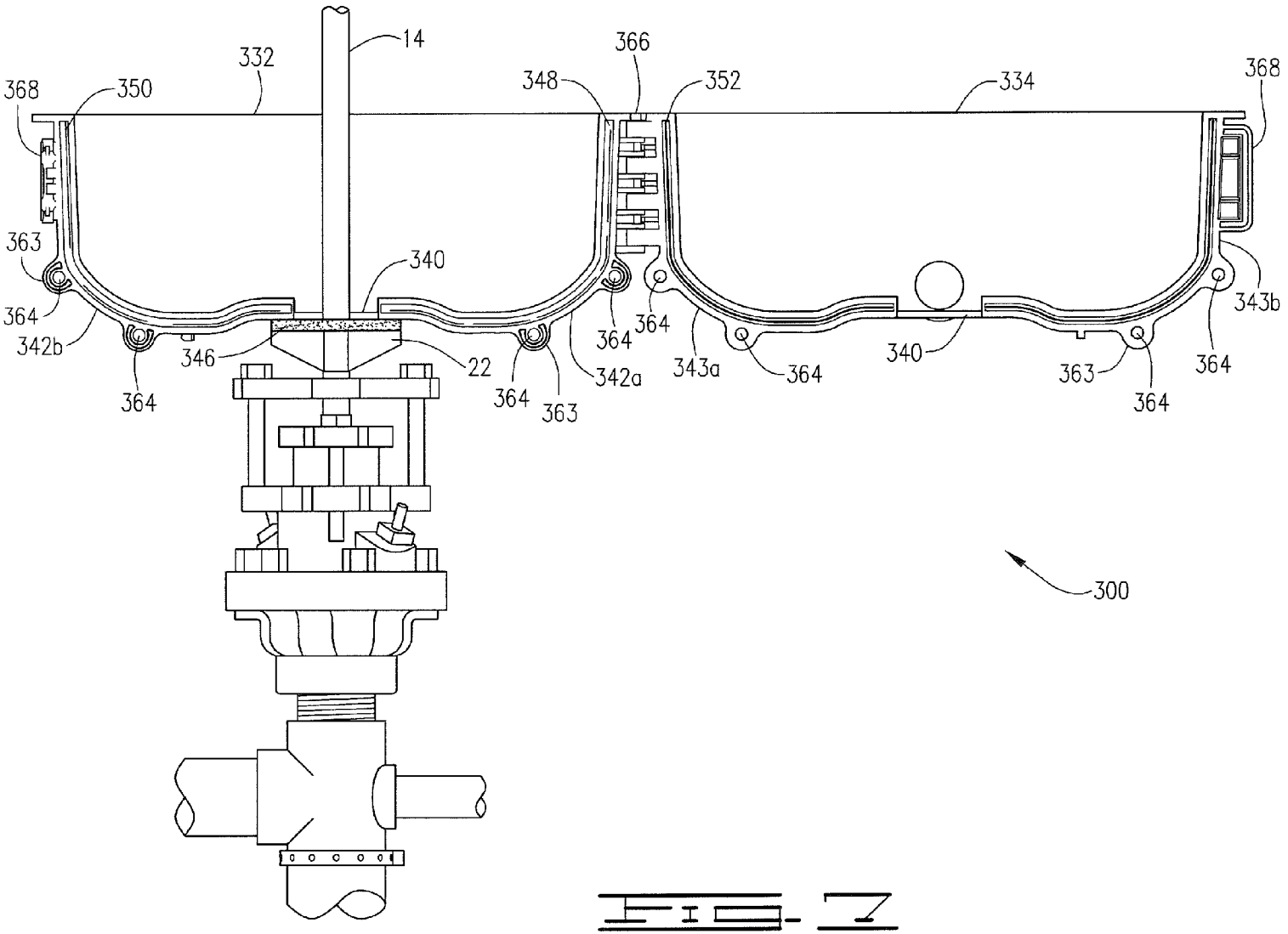
FIG. 7 is a front view of the top-mounting embodiment of the containment apparatus in an open configuration and positioned on the wellhead above the stuffing box.
Figure 5:
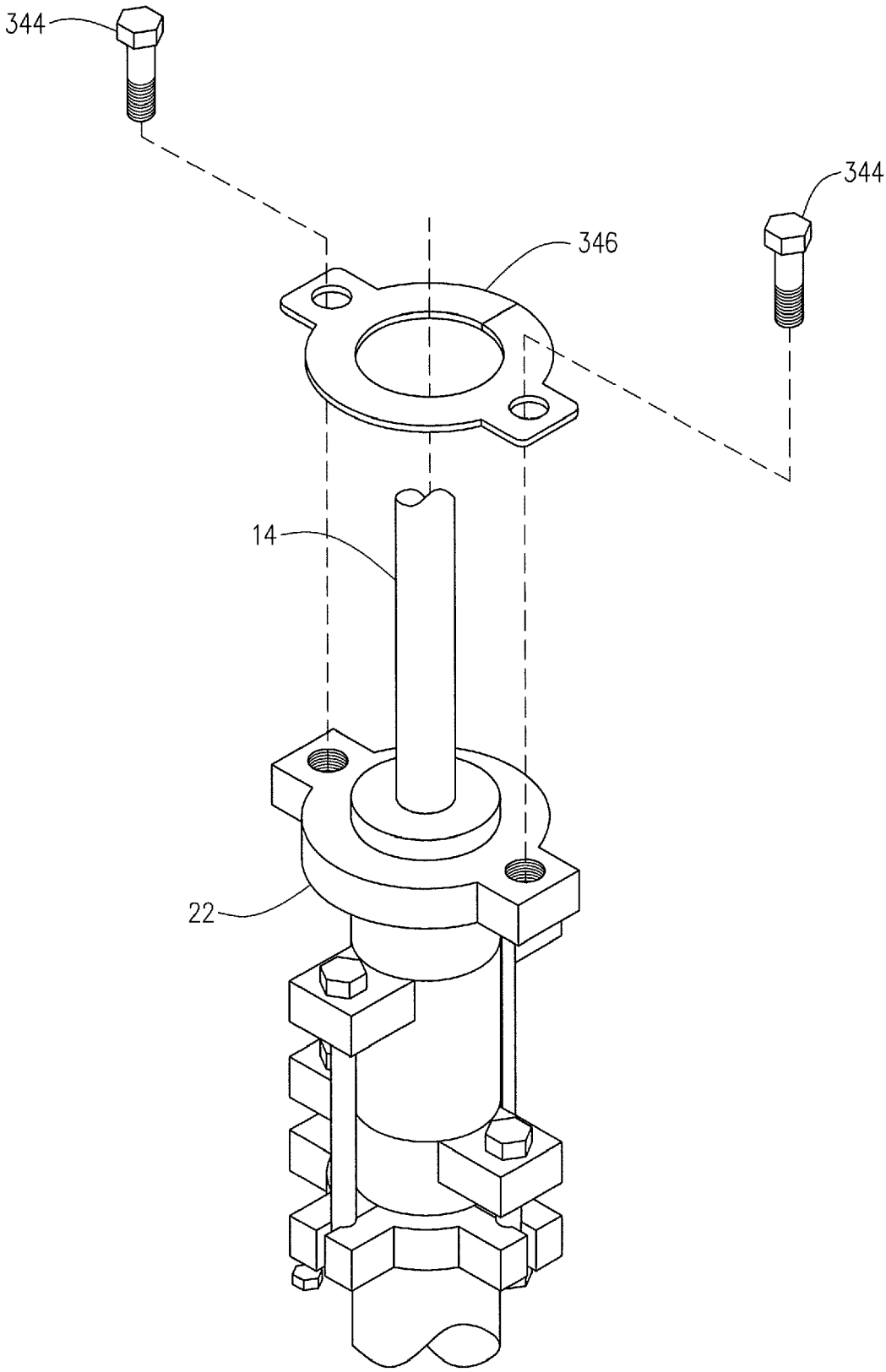
Figure 9:
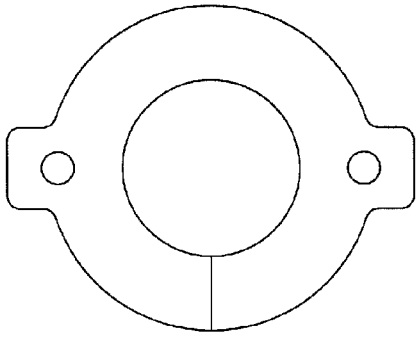
FIG. 9 represents a top-view of the preferred gasket design for use in connection with a Huber Hercules™ or Skinner™ stuffing box for the top-mounting embodiment of the containment apparatus.
Figure 10:
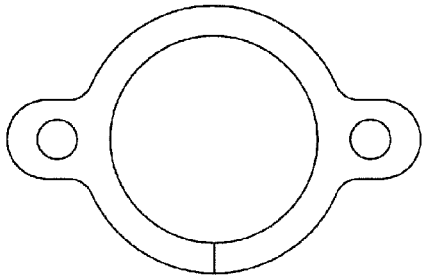
FIGS. 10 and 11 represent top-views of alternative gasket designs for use in connection with a Skinner Cross Twin™ stuffing box for the top-mounting embodiment of the containment apparatus.
Figure 11:
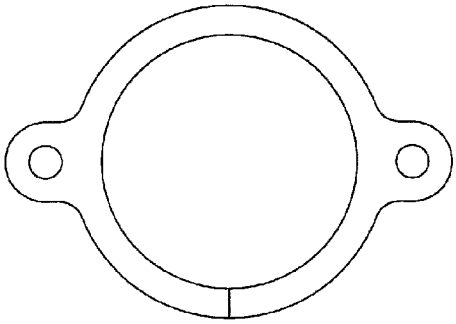
Figure 12:
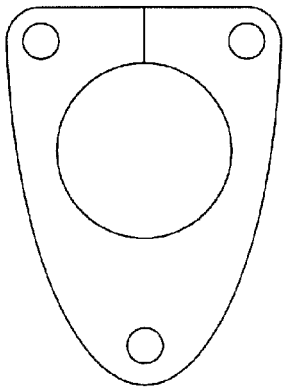
FIG. 12 represents a top-view of the preferred gasket design for use in connection with a Ratigan™ stuffing box for the top-mounting embodiment of the containment apparatus.
Figure 19:
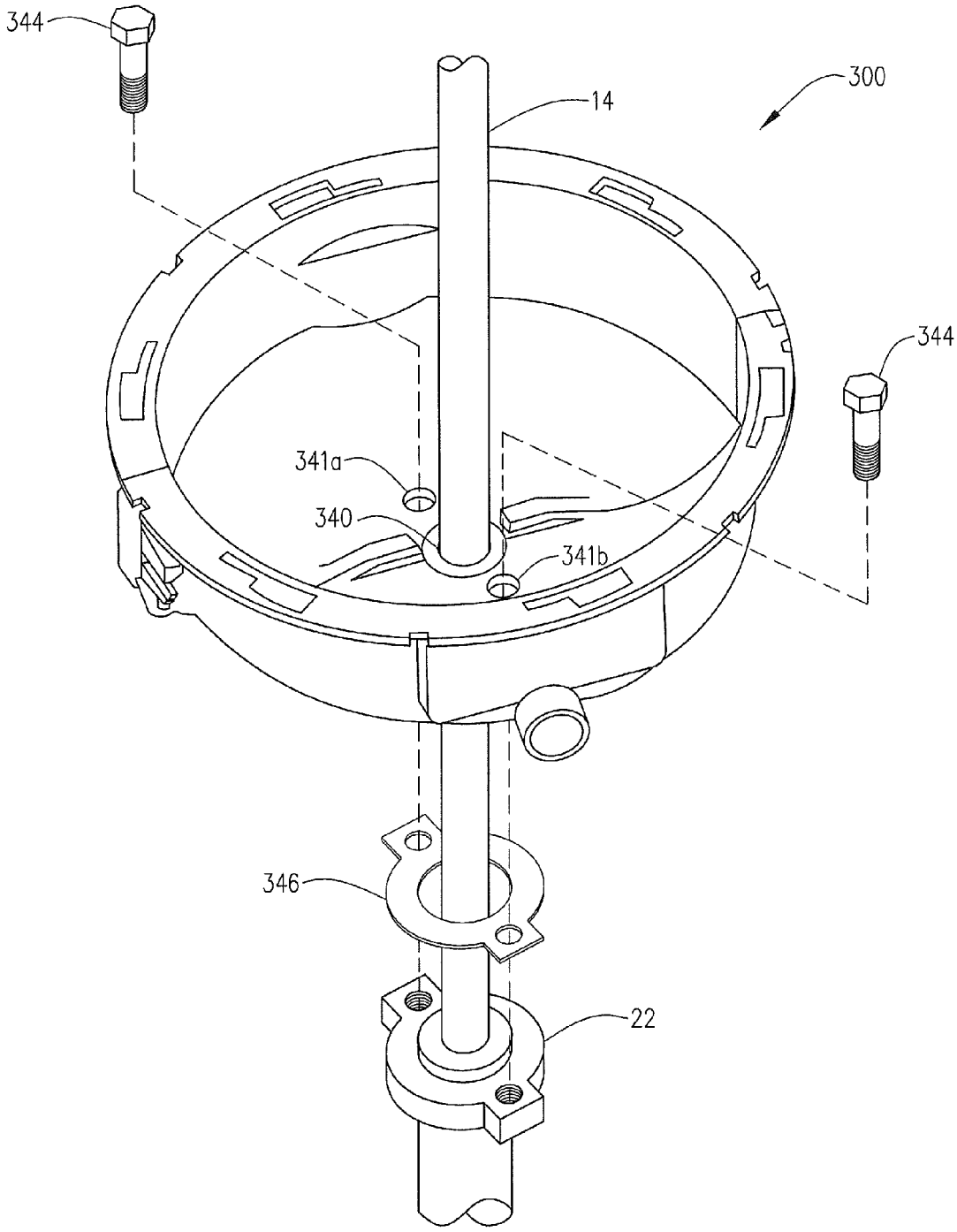

In an alternative embodiment, containment apparatus 10 is secured above stuffing box 12 as depicted in FIGS. 7, 8, and 13. In this top-mounting embodiment, containment vessel 300 has been modified to provide a fluid tight seal to upper lube cap 22. As such, in this embodiment containment vessel 300 does not require a collar portion 40. Instead, mating surfaces 342*a*, 342*b*, 343*a*, 343*b* of the half shells 332, 334 terminate at a lower opening 340. Lower opening 340 permits passage of the polished rod 14 and is flanked on either side by a pair of second openings 341*a*, 341*b*. Second openings 341*a*, 341*b* permit passage of a bolt 344 to secure the containment vessel 300 to lube cap 22.

Second, a single gasket 346 is used in place of the seal subassembly 110 described in the previous embodiment. Gasket 346 is placed on the upper lube cap 22 as depicted in FIG. 8 and preferably conforms to the geometry of the surface of the upper lube cap 22. FIGS. 9-12 provide examples of gaskets 346 which conform to a variety of common lube caps 22. Once gasket 346 is in place on lube cap 22, containment vessel 300 is secured to lube cap 22 and gasket 346 by bolts 344 placed in second openings 341*a*, 341*b* as shown in FIG. 13. Thus, sealing material 350 in channel 348 of first half shell 332 mates with gasket 346 on lube cap 22 providing a liquid tight seal. All other features described above with respect to topper 80 and containment vessel 30 are common to the top-mounting embodiment.

Figure 14:
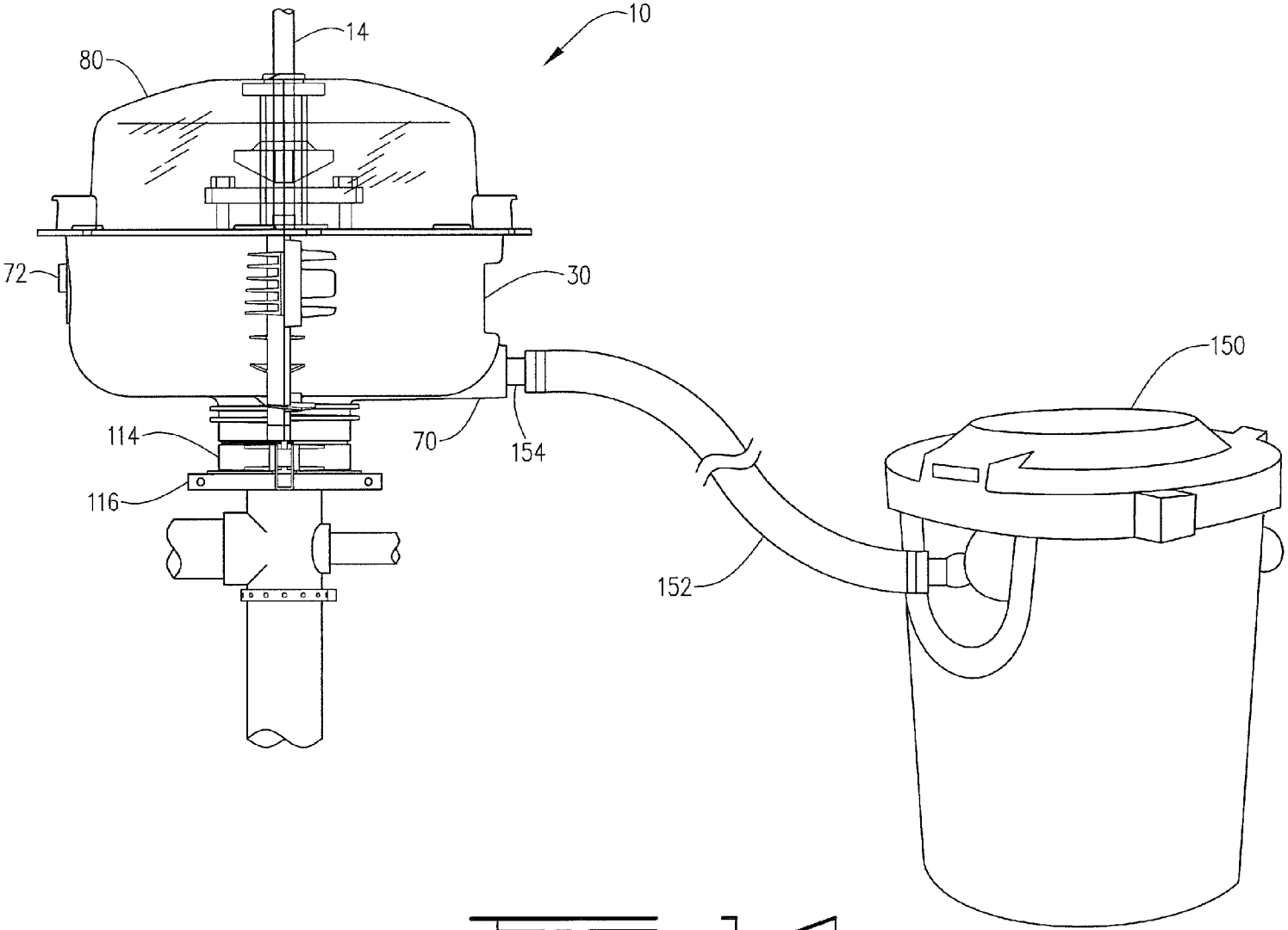
FIG. 14 is a side view of a fully assembled embodiment of the containment apparatus on the wellhead with optional tubing extending from the drain port to a storage container.

FIG. 14 depicts an optional storage container 150 suitable for use in conjunction with either embodiment discussed above. As depicted, optional storage container 150 is in fluid connection with the tee mounted stuffing box containment apparatus 10. In this embodiment, a hose 152 provides a fluid connection between containment vessel 30 and additional storage unit 150. Hose 152 is connected to containment vessel 30 via an adaptor 154 extending from drain port 70.

Containment vessel 30 or 300, seal ring 114 and stabilizer bar 116 can be manufactured from any thermoplastic or thermosetting plastic material suitable for injection molding including, but not limited to polyurethane, polyamide, polyethylene, polypropylene, polystyrene, acrylonitrile butadiene styrene or polyvinyl chloride. Preferably polyurethane will be used for containment vessel 30 and 300. Topper 80 is preferably transparent polycarbonate, but can be manufactured using any durable plastic material. Seal ring 114 and stabilizer bar 116 are preferably polycarbonate.

Gaskets 112, 118, 346 and sealing material 50, 350 are preferably a cellular polyurethane foam such as Poron™. Alternatively, a closed cellular foam such as a Neoprene-EDM-SDR™ blend (PAX P42B™) will perform satisfactorily. Additionally, the gaskets can be replaced with a high-temp neutral cure silicone such as an RTV silicone or Dow Corning™ adhesive sealant. One example of a RTV type silicone material would include, but is not limited to, Dow Corning Product no. 3145 MIL-A-46146, containing 5.0 to 13.0 weight percent methyltrimethoxysilane.

Various connectors can be used in the above described embodiments including, but not limited to standard threaded bolts, spring-loaded hitch pins, D-shaped snapper pins, semi-tubular rivets, split rivets, and thumb screws.

In addition, a grounding system should be applied to the apparatus. In a preferred embodiment a grounding clamp is attached to the wellhead below the pumping tee with a grounding wire extending to one of the bolts on the containment vessel 30 and secured thereto.

The present invention also provides a method for containing leaks at a stuffing box. The steps of the method are outlined with reference to FIGS. 1A, 4A-D, 5 and 6. The preferred characteristics of the parts used in this method are outlined in detail above. Referring to FIG. 1A, the first step requires cleaning of stuffing box base 16, nipple 18 and top of pumping tee 20. These areas should be dry and free from all oil, grease and dirt before proceeding to the second step.

Referring now to FIG. 4A, the second step requires applying first gasket 112 to nipple 18 of stuffing box 12. Once first gasket 112 is in place, the third step, as demonstrated in FIG. 4B, joins halves 114*a*, 114*b* of seal ring 114 around nipple 18. Bolts 127 are preferably used to securely unite halves 114*a*, 114*b* thereby forming sealing ring 114.

In the fourth step, stabilizer bar 116 is positioned on the top portion of pumping tee 20 as depicted in FIG. 4C. When properly positioned on the pumping tee, stabilizer bar 116 supports laterally projecting flange 126 of seal ring 114. Additionally, upwardly extending flanges 132 of the stabilizer bar 116 are received by slots 128 in laterally projecting flange 126. The two halves 116*a*, 116*b* of the stabilizer bar 116 are then secured by tightening the bolts 129 projecting through the openings in the ends of the stabilizer bar 116.

In the fifth step, second gasket 118 is positioned within circumferential groove 120 of seal ring 114 as shown in FIG. 4D. Following the fifth step, the components of the seal subassembly 110 are in place and are able to receive the containment vessel 30.

Referring now to FIGS. 5 and 6 for the sixth step, the first and second shell halves 32, 34 of the containment vessel 30 are positioned on seal subassembly 110. Collar portion 40 of each half shell is positioned on the laterally extending flange 126 of the seal ring 114 such that the tabs 60*a*, 60*b*, 60*c*, 60*d* of the shell halves 32, 34 abut upwardly extending flanges 132 of stabilizer bar 116. In other words, each pair of opposing tabs (60*a*, 60*c* and 60*b*, 60*d*) are separated by upwardly extending flanges 132 and the openings in each (61*a-d*, 133) should be aligned as described above. Shell halves 32, 34 are first secured by fastening the buckle 68. Bolts 65 are then positioned through openings 64 and tightened to ensure that ridge 52 is securely positioned against sealing material 50 in channel 48 of the abutting mating surfaces 42*a*, 43*a* and 42*b*, 43*b*. If seam 54, defined by the abutting mating surfaces 42*a*, 43*a* and 42*b*, 43*b*, is properly sealed, then tabs 60*a*, 60*b*, 60*c*, 60*d* can be bolted to upwardly extending flanges 132 of the stabilizer bar 116.

If seal ring 114 has been omitted, then collar portion 40 of each half shell will be supported by the upper surface of stabilizer bar 116. As described above, tabs 60*a*, 60*b*, 60*c*, 60*d* of the shell halves 32, 34 abut upwardly extending flanges 132 of stabilizer bar 116. Thus, containment vessel will be secured to and supported by stabilizer bar 116. Contact of sealing material 50 in channel 48 with the belt gasket substituted for seal ring 114 will provide the requisite fluid tight seal.

Finally, topper halves 82*a*, 82*b* can be joined as described above and mounted to the containment vessel 30 by inserting downwardly projecting tabs 98 into the bayonet mount receiving slots 100 and turning the topper 80 clockwise. If containment vessel 30 has been properly mounted to seal subassembly 110, polished rod 14 should extend through upper opening 90 of topper 80 without contacting the edges of opening 90.

In an alternative embodiment, the present invention also provides a method for containing leaks from a polished rod 14 and lube cap 22 by positioning containment vessel 300 on top of lube cap 22. In this method, lube cap bolts 344 are removed followed by thoroughly cleaning lube cap 22 to remove all grease, dirt and oil from the surface. A gasket 346 is then applied to the lube cap 22 as depicted in FIG. 8. Gasket 346 is of a size and geometry that substantially conforms to the surface of lube cap 22. With reference to FIG. 7, first and second shell halves 332, 334 of the containment vessel 300 are then joined together such that the polished rod extends through first opening 340. The buckle 368 is then secured and bolts 344 are positioned in second openings 341*a*, 341*b* to secure containment vessel 300 to lube cap 22. Bolts 365 are then applied to openings 364 to ensure that ridge 352 is securely positioned against sealing material 350 in channel 348 of abutting mating surfaces 342*a*, 343*a* and 342*b*, 343*b*. Topper 80 is then applied to containment vessel 300 in the same manner as described above.

Both methods describe above can also include the additional step of connecting the containment vessel 30 (or 300) to additional storage unit 150. As depicted in FIG. 14, a hose 152 provides fluid connection adaptor 154 extending from drain port 70 of containment vessel 30 to storage container 150.

Other embodiments of the current invention will be apparent to those skilled in the art from a consideration of this specification or practice of the invention disclosed herein. However, the foregoing specification is considered merely exemplary of the current invention with the true scope and spirit of the invention being indicated by the following claims.

What is claimed is:

1. An apparatus for protecting the environment from leaks originating from a stuffing box secured to a nipple on a pumping tee comprising:

a first gasket extending from the pumping tee to the nipple such that a portion of the pumping tee and nipple are covered by the gasket;

a stabilizer bar having at least two upwardly extending flanges;

a containment vessel, the containment vessel comprising a first half shell and a second half shell, wherein the first half shell and second half shell each comprise a collar portion wherein the collar portion cooperates with the first gasket when the first half shell and second half shell are joined to form the containment vessel; and wherein the collar portion of each half shell portion carries two tabs, wherein each of the upwardly extending flanges of the stabilizer bar are positioned between tabs from each collar portion when the first half shell and second half shell are joined to form the containment vessel.

2. The apparatus of claim 1, wherein the first half shell has two mating surfaces with a groove running the length of each mating surface; wherein the second half shell has two mating surfaces each carrying an outwardly projecting ridge, and wherein the ridge of the second half shell cooperates with the groove of the first half shell when the first and second half shells are joined to form the containment vessel.

3. The apparatus of claim 2 wherein the groove of the first half shell comprises sealing material.

4. The apparatus of claim 2, wherein the collar portions of the first and second half shells comprise an upper collar portion and a lower collar portion, wherein the mating surfaces of the first and second half shells terminate at the upper collar portion.

5. The apparatus of claim 1, wherein the tabs extend laterally in opposite directions from the lower collar portion.

6. The apparatus of claim 5, wherein the tabs are set back from the mating surfaces such that when the first half shell is joined with the second half shell, a space exists between opposing tabs of the first half shell and second half shell.

7. The apparatus of claim 1, wherein the stabilizer bar includes a first support beam secured to a second support beam, each support beam includes a centrally located offset suitable for receiving a portion of the pumping tee.

8. The apparatus of claim 7, wherein the centrally located offset of each support beam carries at least one upwardly extending flange.

9. The apparatus of claim 7, wherein the centrally located offset of each support beam carries two upwardly extending flanges.

10. The apparatus of claim 9, wherein the two upwardly extending flanges of each support beam are joined to one another by an integral spacer.

11. The apparatus of claim 1, wherein the upwardly extending flanges have a flange opening and wherein the tabs comprise tab openings; and, wherein the flange openings and the tab openings are aligned such that a connector can be placed through the flange openings and tab openings to secure the liquid tight containment device to the stabilizer bar.

12. The apparatus of claim 1, further comprising a topper positioned on the liquid tight containment vessel, the topper having an upper opening.

13. The apparatus of claim 12, wherein the liquid tight containment vessel has an upper rim, the upper rim carrying at least two bayonet mount receiving slots and wherein the topper has a lower rim, the lower rim carrying at least two downwardly projecting tabs, the topper is secured to the liquid tight containment vessel by cooperation of the downwardly projecting tabs with the bayonet mount receiving slots.

14. The apparatus of claim 12, wherein the topper is transparent.

15. An apparatus for protecting the environment from leaks originating from a stuffing box secured to a nipple on a pumping tee comprising:

a first gasket positioned on the nipple;

a containment vessel comprising a first half shell and a second half shell;

the first half shell comprising two mating surfaces having a groove therein, wherein the groove comprises sealing material;

the second half shell comprising two mating surfaces carrying an outwardly projecting ridge, wherein the ridge of the second half shell cooperates with the sealing material of the first half shell to form the containment vessel;

wherein the containment vessel comprises a lower opening that is in contact with the first gasket when the containment vessel is secured to the nipple; and a topper positioned on the containment vessel, the topper having an upper opening.

16. The apparatus of claim 15, wherein the topper is transparent.

17. An apparatus for protecting the environment from leaks originating from a stuffing box secured to a nipple on a pumping tee comprising:

a first gasket extending from the pumping tee to the nipple such that a portion of the pumping tee and nipple are covered by the gasket;

a stabilizer bar comprising at least two upwardly extending flanges, wherein each flange has a flange opening therein;

a containment vessel comprising a floor, an upstanding wall, and a collar, wherein the collar is in contact with the first gasket;

the collar comprising an upper collar portion and a lower collar portion, the lower collar portion carrying two pairs of opposing tabs, wherein each tab has a tab opening therein; and wherein each upwardly extending flange is received between one pair of opposing tabs such that the tab openings are aligned with the flange openings thereby permitting receipt of a connector to secure the containment vessel to the stabilizer bar.

18. The apparatus of claim 17, wherein the containment vessel comprises a first half shell and a second half shell, wherein the first half shell has two mating surfaces with a groove running the length of each mating surface; wherein the second half shell has two mating surfaces each carrying an outwardly projecting ridge, and wherein the ridge of the second half shell cooperates with the groove of the first half shell to form the containment vessel.

19. The apparatus of claim 17, wherein the stabilizer bar includes a first support beam secured to a second support beam, each support beam includes a centrally located offset suitable for receiving a portion of the pumping tee.

20. The apparatus of claim 19, wherein the centrally located offset of each support beam carries at least one upwardly extending flange.

* * * * *